US005543902A

United States Patent [19]

Takeda et al.

[11] Patent Number: 5,543,902

[45] Date of Patent: Aug. 6, 1996

[54] DEVELOPING DEVICE FOR AN IMAGE FORMING APPARATUS

[75] Inventors: Fuchio Takeda, Tokyo; Atsushi Ohta, Yokohama, both of Japan

[73] Assignee: Ricoh Company, Ltd., Tokyo, Japan

[21] Appl. No.: 466,834

[22] Filed: Jun. 6, 1995

Related U.S. Application Data

[63] Continuation of Ser. No. 168,157, Dec. 17, 1993, abandoned.

[30] Foreign Application Priority Data

Dec. 18, 1992 [JP] Japan ..... 4-355737

[51] Int. Cl.[6] ..... G03G 15/06

[52] U.S. Cl. ..... 355/259; 355/245

[58] Field of Search ..... 355/245, 246, 355/259; 118/661

[56] References Cited

U.S. PATENT DOCUMENTS

| | | | |
|---|---|---|---|
| 4,994,319 | 2/1991 | Nojima et al. | 355/259 X |
| 5,017,967 | 5/1991 | Koga | 355/259 X |
| 5,170,213 | 12/1992 | Yamaguchi et al. | 355/246 |
| 5,172,169 | 12/1992 | Takashima et al. | 355/246 |
| 5,177,537 | 1/1993 | Okano et al. | 355/259 |

FOREIGN PATENT DOCUMENTS

| | | |
|---|---|---|
| 0515210A2 | 11/1992 | European Pat. Off. . |
| 59-111658 | 6/1984 | Japan . |

*Primary Examiner*—Fred L. Braun

*Attorney, Agent, or Firm*—Oblon, Spivak, McClelland, Maier & Neustadt, P.C.

[57] ABSTRACT

A developing device for an image forming apparatus and capable of maintaining desirable image quality by reducing a change in the charged state of the surface of a developing roller and a change in the amount of charge to deposit on a developer. An insulating layer constitutes the surface of the developing roller and is made of a material more than 50 percent of which constitutes a non-polar high molecule. This prevents a toner from filming the surface of the roller. The insulating layer is implemented by a material substantially the same as the toner in charge series, so that the toner is frictionally charged by a member other than the developing roller. A discharge brush is held in contact with the roller and made of a material substantially identical with the toner in charge series, thereby preventing the toner from being frictionally charged by the brush even when the toner films the roller. Further, the insulating layer is constituted by a material in which a non-polar high molecule and a polar high molecule are mixed in a suitable ratio. As a result, a space charge is scarcely stored in the surface of the roller, thereby preventing a charge from being injected into the roller surface.

15 Claims, 5 Drawing Sheets

DEVELOPING DEVICE FOR AN IMAGE FORMING APPARATUS

This application is a Continuation of application Ser. No. 08/168,157, filed on Dec. 17,1993, now abandoned.

BACKGROUND OF THE INVENTION

1. Field of the Invention

The present invention relates to a developing device for a copier, facsimile apparatus, printer or similar image forming apparatus and, more particularly, to a developing device of the type developing an electrostatic latent image formed on an image carrier with a thin layer of one component type developer formed on a developer carrier.

2. Discussion of the Background

A conventional developing device of the type described is located to face a photoconductive belt or similar image carrier. The device has a developing roller or similar developer carrier. A conductive blade contacts or adjoins the surface of the developing roller at the edge thereof and plays the role of a developer regulating member. A discharge brush is located downstream, with respect to the rotation direction of the roller, of a developing region where the belt and roller contact each other. The discharge brush contacts the roller at such a position and serves as surface potential stabilizing means. A power source is connected to the roller, blade, and discharge brush. Developer supplying means supplies a developer to the roller. The roller carries a developer fed from the supplying means thereon and conveys it toward the belt. At this instant, the blade regulates the thickness of the developer deposited on the roller, thereby forming a thin developer layer. When the developer passes through the gap between the blade and the roller, it is charged to a predetermined polarity due to the friction thereof with the surface of the roller and the edge of the blade. As the charged developer arrives at the developing region due to the rotation of the roller, it is transferred to the belt to develop a latent image electrostatically formed thereon. Subsequently, the charge remaining on the roller is dissipated by the discharge brush. As a result, the residual image of the developed pattern is prevented from appearing afterwards. Such a procedure is repeated thereafter.

Some different approaches have heretofore been proposed to charge the developer to a desired polarity sufficiently. For example, the developing roller or similar member for depositing a charge on the developer by friction may contain a polyvinyl alcohol resin on the surface thereof in order to charge the developer to a predetermined polarity sufficiently, as taught in Japanese Patent Laid-Open Publication (Kokai) No. 56-159674 by way of example. Alternatively, the surface of the developing roller may be implemented by a copolymer of vinylester monomers, as proposed in, for example, Japanese Patent Laid-Open Publication No. 56-91262. Further, the surface of the developing roller may be treated with a stylene copolymer, acryl copolymer, polycarbonate, polyamide, polyvinyl chloride, polyvinyl acetate or similar thermoplastic resin to form a resin layer, and then the roller may be bodily subjected to heat treatment at a temperature higher than glass transition point, as disclosed in Japanese Patent Laid-Open Publication No. 57-64268 by way of example.

Regarding a developing device using a two component type developer, i.e., a mixture of toner and carrier, some implementations have been proposed to promote the charging of the developer and which miniaturize and simplify the structure of the device. One of them is to cover the surface of the developing roller with a polyester resin or similar insulating material chargeable to a polarity opposite to the polarity of the toner, and use a discharge plate produced by depositing aluminum on a Mylar or similar insulating film by vacuum evaporation. The discharge plate is connected to ground and held in contact with the developing roller to dissipate the charge of the roller. This kind of scheme is taught in, for example, Japanese Patent Laid-Open Publication 1-169472.

The problem with the conventional developing devices is that fine particles of the developer and additives included in the developer deposit on the surface of the developing roller. This is usually referred to as filming and prevents the developer from being sufficiently charged by friction, thereby reducing the amount of charge. Another problem is that when the charge due to the friction of the developer and roller surface is intense, it sometimes occurs that the surface potential of the roller sequentially increases with the elapse of time. Further, it is likely that the roller surface is frictionally charged by the discharge brush. Such occurrences change the developing characteristic, i.e., the potential of the surface of the photoconductive belt where development begins, and so-called gamma characteristic, adversely effecting images. Therefore, it is preferable that the roller surface be restored to the initial state before the next developing cycle begins.

In the devices taught in previously mentioned Laid-Open Publication Nos. 56-159674 and 56-91262, the surface of the developing roller is positively used to charge the developer. As a result, the potential of the roller surface becomes offset to one polarity with the elapse of time. Hence, some discharging means is required. However, since the roller surface is insulating, the discharging means is apt to charge the roller surface by friction in contact therewith, depending on the material thereof.

The device disclosed in Laid-Open Publication No. 57-64268 has a drawback in that the roller surface is susceptible to moisture since it is implemented by a polar high molecule. In addition, the fine particles of the developer electrostatically adhere to the roller surface fast. As a result, the charging of the developer is obstructed.

Further, the device proposed in Laid-Open Publication No. 1-169472 has, in addition to the problems of Laid-Open Publication No. 57-64268, a problem in that the material and configuration of the discharge plate are likely to prevent the roller surface from being sufficiently charged. Specifically, in a construction taught in No. 1-169472 specifically, aluminum is deposited on the discharge plate by vacuum evaporation. However, aluminum is not feasible for discharging since an insulating layer of aluminum oxide is formed on the surface of aluminum. Moreover, since the discharge plate contacts the roller surface tangentially at a flat portion thereof, it cannot discharge the roller surface sufficiently when, for example, the fine particles of the developer electrostatically adhere to the roller surface fast, as stated earlier.

SUMMARY OF THE INVENTION

It is, therefore, an object of the present invention to provide a developing device for an image forming apparatus which ensures high image quality at all times by reducing a change in the charged state of the surface of a developer carrier and a change in the amount of charge to deposit on the developer.

In accordance with the present invention, a developing device incorporated in an image forming apparatus for developing a latent image electrostatically formed on an image carrier with a one component type developer having high resistance comprises a developer regulating member made of a conductive material for regulating the thickness of the developer, and a developer carrier made up of a conductive base and an insulating layer formed on the conductive base and made of a predetermined material. A predetermined potential is set up between the developer regulating member and the conductive base of the developer carrier.

Also, in accordance with the present invention, a developing device of the type described comprises a developer regulating member made of a conductive material for regulating the thickness of the developer, a developer carrier made up of a conductive base and an insulating layer formed on the conductive base, and a surface potential stabilizing member located between a developing region where the image carrier and developer carrier face each other and a developer supply member, and held in contact with the developer carrier for dissipating a charge remaining on the surface of the developer carrier. The surface potential stabilizing member is made of a material substantially identical with the developer in charge series. A predetermined potential is set up between the developer regulating member and the conductive base of the developer carrier.

Further, in accordance with the present invention, in a developing device for an image forming apparatus and comprising a developer carrier made up of a conductive base and an insulating layer formed on the conductive base for developing an electrostatic latent image formed on an image carrier with a one component type developer having high resistance, the insulating member of the developer carrier is made of a material produced by mixing a non-polar high molecule and a polar high molecule in a suitable ratio and scarcely storing a space charge.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 5:
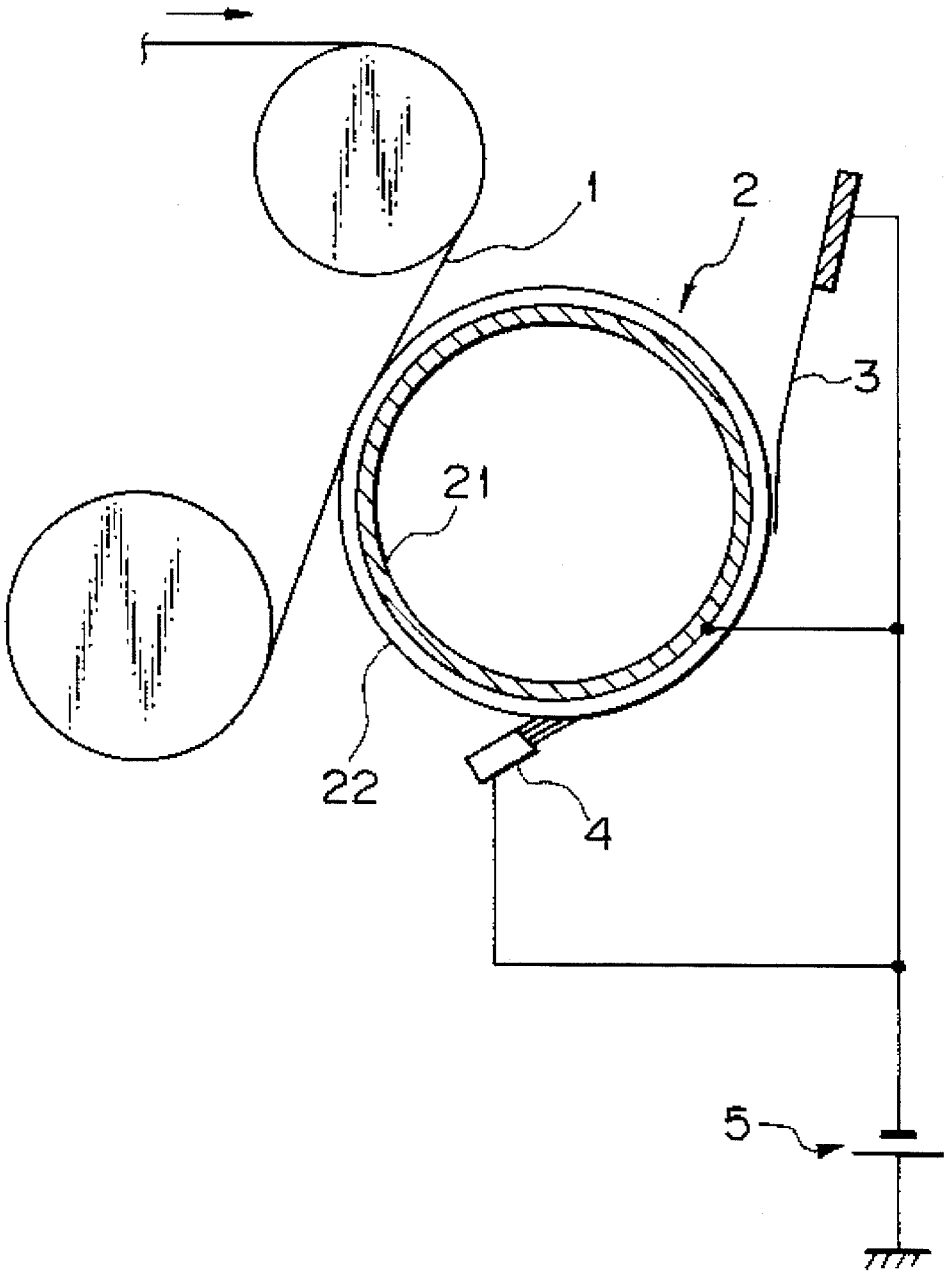
Fig. 5 PRIOR ART
FIG. 5 is a schematic view showing a conventional developing device to which the present invention is applicable.

Referring to FIG. 5 of the drawings, a conventional developing device is shown which is located to face a photoconductive element 1. The photoconductive element 1 is implemented as a belt rotated in the direction indicated by an arrow in the figure. The developing device has a developing roller, or developer carrier, 2 made up of a conductive base 21 and a single insulating layer 22 formed on the base 21. The roller 2 is held in contact with the belt 1. A conductive blade 3 contacts or adjoins the surface of the roller 2 at the edge thereof and plays the role of a developer regulating member. A discharge brush 4 is located downstream, with respect to an intended direction of rotation of the roller 2, of a developing region where the belt 1 and roller 2 face each other. The discharge brush 4 contacts the roller 2 at such a position and serves as surface potential stabilizing means. A power source 5 is connected to the base 21 of the roller 2, blade 3, and discharge brush 4. A developer supplying means, not shown, supplies a developer to the roller 2.

As a developer is fed to the roller 2 by the developer supplying means, the roller 2 carries it thereon and conveys it toward the developing region. At this instant, the blade 3 regulates the thickness of the developer deposited on the roller 2, thereby forming a thin developer layer. When the developer passes through the gap between the blade 3 and the roller 2, it is frictionally charged to a predetermined polarity by the surface of the roller 2 and the edge of the blade 3. As the charged developer arrives at the developing region due to the rotation of the roller 2, it is transferred to the belt 1 to develop a latent image electrostatically formed on the belt 1. Subsequently, the charge remaining on the roller 2 is dissipated by the discharge brush 4. As a result, the residual image of the developed pattern is prevented from appearing afterwards. Such a procedure is repeated thereafter.

The present invention is applicable to the above-described type of developing device. Preferred embodiments of the developing device in accordance with the present invention will be described in relation to an electrophotographic copier belonging to a family of image forming apparatuses. The embodiments will be described with reference also made to FIG. 5 since the basic arrangement thereof is similar to the conventional device. In FIG. 5, assume that the insulating layer 22 of the roller 22 has a thickness t and a specific inductive capacity $\epsilon$, and that the thickness t is so adjusted as to satisfy a relation:

$$30\ \mu m \leqq \frac{t}{\epsilon} \leqq 200\ \mu m$$

Further, assume that the developer is implemented as a single component type developer having high resistance, i.e., a toner.

In a first embodiment of the present invention, the developing roller 2 has the surface thereof made of a non-polar substance. This prevents the fine particles and additives of the toner from depositing on the surface of the roller 2 due to polarization force and intermolecular force, thereby eliminating filming. Specifically, when the surface of the roller 2 is used to charge the toner by friction, the toner, among others, unavoidably films the roller 2. Filming due to the toner, as well as the other components, is apt to occur particularly when the blade 3 is made of a magnetic resilient material and pressed against the roller 2 by magnetism or mechanical pressure. In such a case, it is a common practice to elaborate the material, dimensions, edge configuration and other factors of the blade 3. However, when the blade 3 is made of a material of strong polarity, e.g., urethane, nylon, acryl, stylene or vinyl, it is impossible to eliminate filming despite the elaboration of the dimensions, edge configuration, etc. Filming renders the charged state of the toner unstable.

Figure 1:
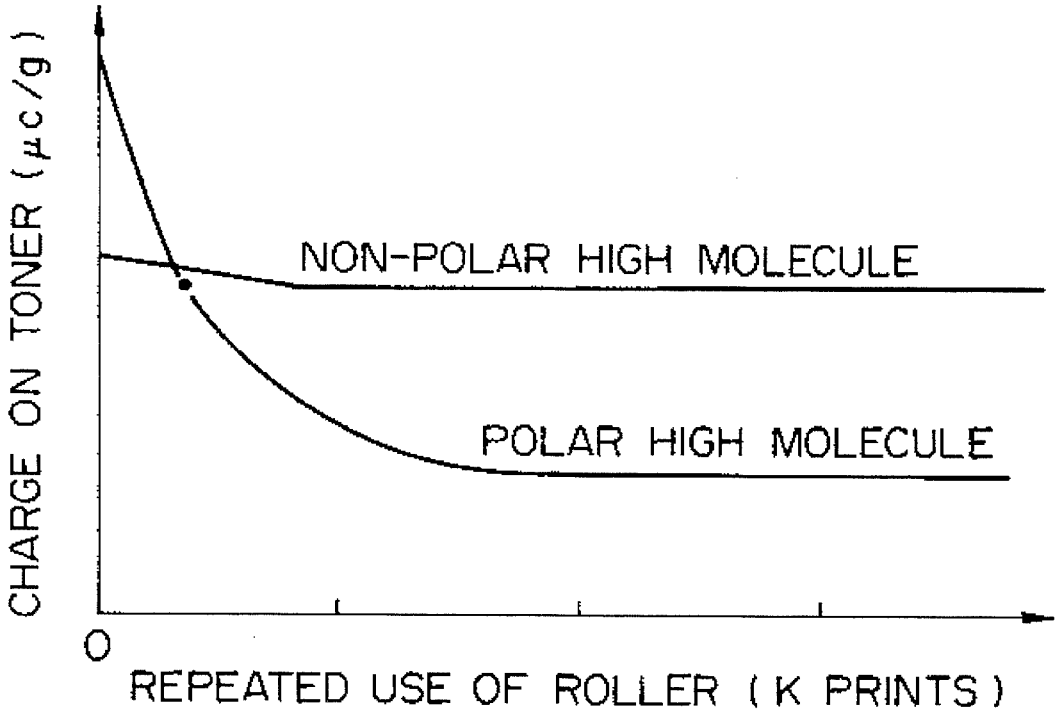
FIG. 1 is a graph indicative of changes in the amount of charge deposited on a toner with respect to two different substances implementing the surface of a developing roller.

More specifically, assume that the insulating layer 22 of the roller 2 is made of a polar high molecular substance. Then, as shown in FIG. 1, the amount of charge (μC/g) deposited on the toner is great at the initial stage, but it sequentially decreases due to repeated development. At the initial stage, since filming due to the toner and additives does not occur on the insulating layer 22, the toner is sufficiently charged by the friction thereof with the surface of the roller 2, i.e., insulating layer 22 and the conductive blade 3. However, as the development is repeated, the toner and others sequentially films the insulting layer 22. Consequently, the toner filming the insulating layer 22 and a toner newly supplied to the roller 2 rub against each other, producing inversely charged toner particles. These toner particles render the charged state of the toner unstable.

To eliminate the above problem, in the illustrative embodiment, the insulating layer 22 is made of a material more than 50 percent of which comprises a non-polar high molecular substance, typically polypropylene or polyethylene. As FIG. 1 indicates, when the layer 22 has such a composition, the amount of charge deposited on the toner remains stable for a long time since the toner and others are prevented from depositing on the roller 2 easily, although it is initially lower than in the case with the polar high molecular substance. Specifically, in the initial stage, the amount of charge is smaller than in the case with the polar high molecular substance since the toner is charged mainly by the friction of the blade 3 and a polarity control agent contained in the toner. However, since the major component of the insulating layer 22 is a non-polar high molecular substance, filming of the roller 2 due to the toner is suppressed. This preserves the stable charge of the toner over a long period of time by eliminating, for example, inversely charged toner particles attributable to the friction of the toner filming the roller 2 and the toner newly supplied to the roller 2.

The embodiment charges the toner mainly by the friction of the blade 3 and the polarity control agent of the toner, as stated above. Therefore, a sufficient amount of negative charge is deposited on the toner despite that polypropylene, polyethylene or a similar substance is apt to be negatively charged due to the inherent charge series thereof.

Figure 2A:
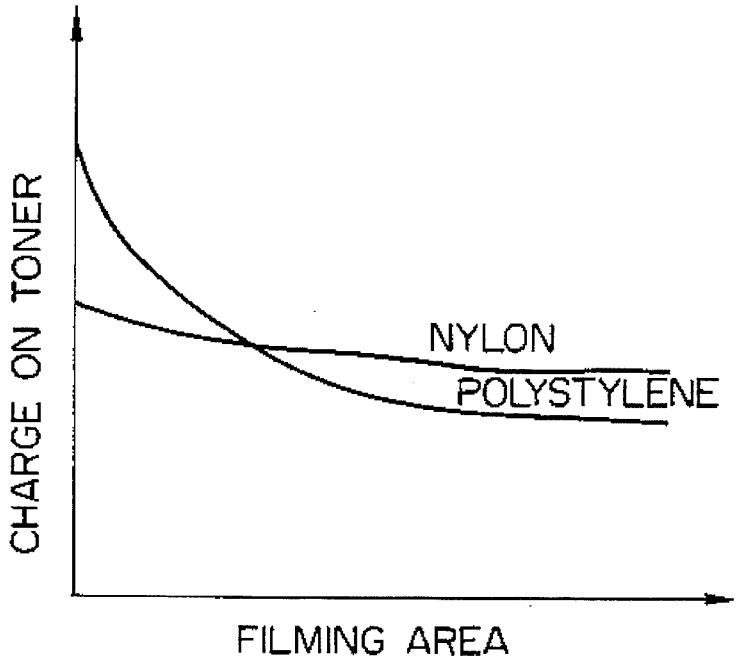
FIG. 2A is a graph representative of a relation between the amount of charge and the filming area with respect to two different substances implementing the roller surface, and determined with a positively chargeable toner.
Figure 2B:
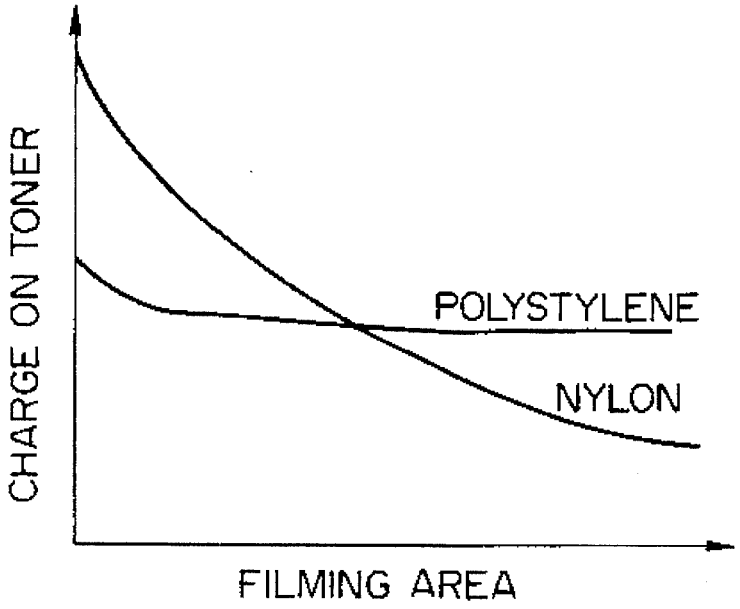
FIG. 2B is a graph similar to FIG. 2A, showing a relation determined with a negatively chargeable toner.

A second embodiment to be described hereinafter avoids the friction of the roller 2 and the toner as far as possible, thereby reducing a change in the charge deposited on the toner to occur with the elapse of time. Experiments were conducted by using a toner A containing a positive polarity control agent, a toner B containing a negative polarity control agent, an insulating layer 22 made of polystylene resin apt to charge to negative polarity in respect of charge series, and an insulating layer 22 made of nylon resin apt to charge to positive polarity. FIGS. 2A and 2B are respectively associated with the toners A and B, and each shows how the amount of charge of the toner changes with the increase in the filming area of the toner. In FIGS. 2A and 2B, the abscissa indicates the filming area of the toner on the surface of the roller 2, while the ordinate indicates the amount of charge.

As shown in FIG. 2A, when use is made of the toner A with the positive polarity control agent and the insulating layer 22 made of polystylene resin, a relatively great amount of charge is deposited on the toner in the initial stage. However, the charge noticeably decreases as the filming area due to the toner A increases, for the following reason. Initially, so long as the roller 2 is not filmed by the toner A, the toner A is frictionally charged by the insulating layer 22, the edge of the blade 3, and the discharge brush 4. As the roller 2 is sequentially filmed by the toner A, a toner A newly deposited on the roller 2 is not frictionally charged by the insulating layer 22, but it is charged only by the blade 3 and discharge brush 4.

Regarding the toner A and the insulating layer 22 made of nylon resin, the amount of charge initially charged on the toner is not great. However, the amount of charge scarcely changes despite the increase in the filming area due to the toner A. Specifically, since the nylon resin constituting the insulating layer 22 is apt to charge to positive polarity, the toner A is frictionally charged by the blade 3 and discharge brush 4, but not by the layer 22, even in the initial condition wherein the roller 2 is not filmed by the toner A. Although the roller 2 is sequentially filmed by the toner A, the toner A originally is charged little by the friction thereof with the insulating layer 22 and is continuously charged by the blade 3 and discharge brush 4.

Assume the toner B with the negative polarity control agent and the insulating layer 22 made of nylon resin which is apt to charge to positive polarity in respect of charge series. Then, as shown in FIG. 2B, a relatively great amount of charge is achievable in the initial state. However, the charge noticeably decreases as the filming area due to the toner B increases. This is accounted for by the same situation as stated in relation to the toner A and the insulating layer 22 made of polystylene resin.

When the insulating layer 22 made of polystylene resin is used in combination with the toner B, a relatively great amount of charge is not deposited in the initial stage. However, the charge changes little despite that the filming area due to the toner B sequentially increases. Why this occurs is the same as with the combination of the toner A and the insulating layer 22 made of nylon resin.

As discussed above, although the toners A and B both film the roller 2 without regard to the material of the insulating layer 22, the stability of the amount of toner charge noticeably differs depending on the material of the layer 22. Namely, the amount of toner charge changes less when the insulating layer 22 is made of a substance closer to the toner A or B in respect of charge series. Specifically, when the surface of the roller 2 is made of a substance close to the toner in terms of charge series, the toner is scarcely charged by the friction thereof with the surface of the roller 2, i.e. it is charged by the blade 3 and discharge brush 4. Hence, despite that the toner films the roller 2, the toner newly deposited on the roller 2 is successfully charged.

Based on the above finding, the illustrative embodiment makes the insulating layer 22 of a substance close to the toner in respect of charge series, so that the toner is charged by factors other than the friction thereof with the surface of the roller 2, e.g., the blade 3 and brush 4. As a result, the factors charging the toner do not change despite that the toner films the surface of the roller 2. Therefore, the amount of charge deposited on the toner remains stable despite the filming.

Should the toner adhere to, for example, the blade 3, the amount of toner charge would become unstable. However, since the blade 3 is generally made of metal or similar material easy to shave, the embodiment ensures a stable amount of toner charge by maintaining the blade 3 in the initial state at all times. In this connection, since the roller 2 is made of metal or a similar highly wear-resistant material, it is more likely to be filmed by the toner than the blade 3.

Hereinafter will be described a third embodiment of the developing device in accordance with the present invention.

Briefly, this embodiment reduces a change in the potential on the surface of the roller 2 by making the discharge brush 4 of a particular material. Generally, it has been accepted that a charge remaining on the insulating layer 22 can be dissipated if a conductive member is held in contact with the layer 22. However, when the object to be discharged is an insulating material, the charge cannot always be dissipated even when a conductive member is held in contact therewith; rather, the conductive member is likely to promote the charging of the layer 22.

Figure 3:
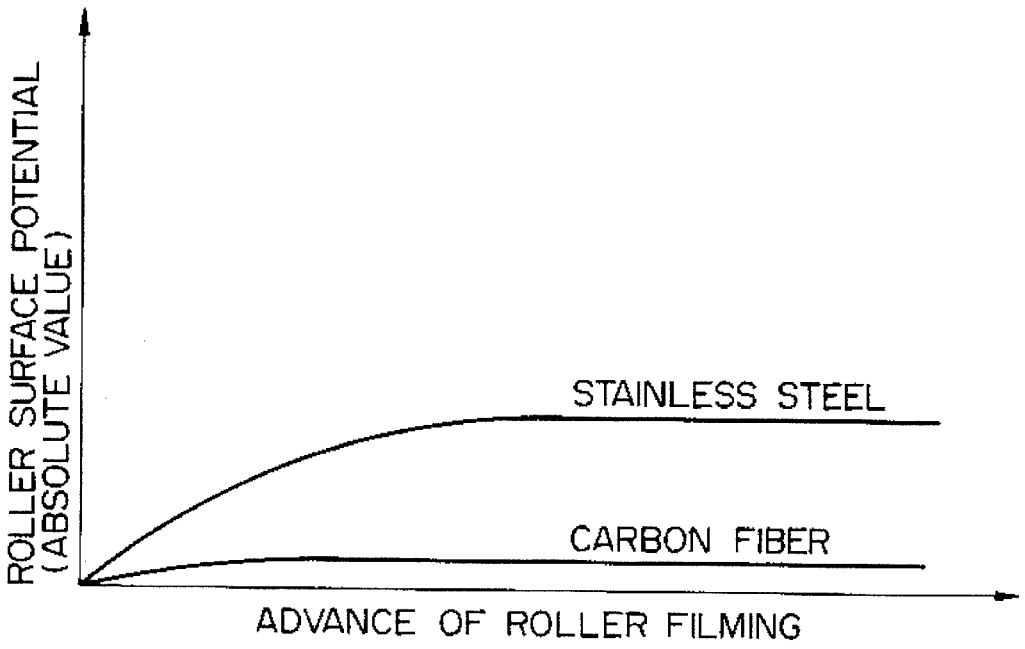
FIG. 3 is a graph indicative of changes in the surface potential of the roller with respect to two different materials implementing a discharge brush.

FIG. 3 shows how the potential on the surface of the roller 2 changes with the advance of the filming due to the toner with respect to discharge brushes 4 made of stainless steel and carbon fibers, respectively. In FIG. 3, the abscissa indicates the advance of filming while the ordinate indicates the potential (absolute value) deposited on the roller 2. Assume that the toner is negatively chargeable. The brush 4 formed of carbon fibers has higher contact resistance than the brush 4 made of stainless steel. Regarding the charge series, carbon fibers are closer to the toner than stainless steel.

Under the above conditions, assume that the brush 4 made of stainless steel is used. Then, as the filming due to the toner advances, the surface potential of the roller 2 noticeably changes to the negative side. This is because the toner filming the roller 2 and stainless steel constituting the brush 4 are not close to each other in charge series, i.e., the brush 4 charges the filming toner by friction. By contrast, when use is made of the brush 4 formed of carbon fibers, the potential on the roller 2 scarcely changes to the negative side despite the advance of filming. This is because the toner filming the roller 2 and carbon fibers constituting the brush 4 are so close in charge series to each other, the brush 4 does not charge the filming toner by friction.

As stated above, although both the carbon fiber brush 4 and the stainless steel brush 4 cause the toner to film the roller 2, the stability of potential on the roller 2 is noticeably dependent on the material of the brush 4. Specifically, when the brush 4 is made of a material close to the toner in charge series, the toner is scarcely charged by the friction thereof with the brush 4. Hence, despite that the toner films the roller 2, it is not charged by the brush 4.

Based on the above finding, this embodiment makes the discharge brush 4 of a material close to the toner in charge series so as to prevent the toner from being frictionally charged by the brush 4. In this condition, although the toner may film the roller 2, it is not frictionally charged by the brush 4, allowing a potential to be stably deposited on the roller 2.

Figure 4:
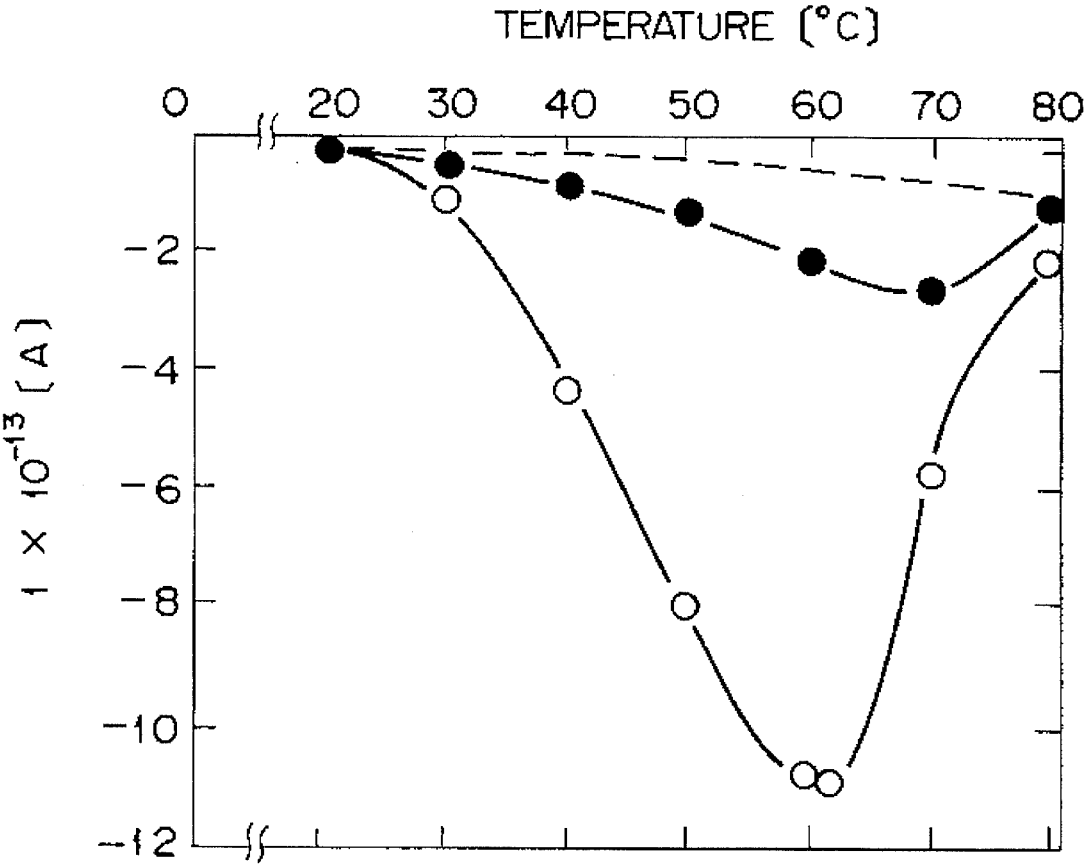
FIG. 4 is a graph showing the storage of a space charge particular to a material prepared by mixing low density polyethylene and ionomer in a suitable ratio.

A fourth embodiment of the present invention will be described which eliminates, for example, a change in the potential to deposit on the roller 2 despite the elapse of time. Briefly, this embodiment prevents charges from being injected into the insulating layer 22 due to the contact thereof with the toner and discharge brush 4, an electric field derived from a difference in potential between the latent image formed on the belt 1 and a bias voltage, etc. For this purpose, in the embodiment, the insulating layer 22 is made of a substance of the kind storing a minimum of space charge This kind of substance may be produced by mixing a non-polar high molecule and a polar high molecule in a suitable ratio. For example, about 20% of ionomer may be mixed with low density polyethylene by polymer blending, as shown in FIG. 4 (Fukagawa et al. "Development of DC XLPE Cable", Power Central Research Report No. 281038, 1982. If desired, ionomer may be replaced with polyamide. Since a non-polar high molecule and a polar high molecule are generally not easily resolvable in each other, the above-stated substance is prepared by chemical coupling based on bridging or the like.

When the insulting layer 22 is made of such a material storing a minimum of space charge, there can be eliminated charge injection into the layer 22 due to the contact thereof with the toner and brush 4, an electric field attributable to a difference in potential between the latent image formed on the belt 1 and a bias voltage, etc. Consequently, the developing characteristic and, therefore, the resulting image is prevented from changing due to a residual image and a change in the surface potential of the roller 2 with the elapse of time.

In summary, the first embodiment prevents the fine particles and additives of a developer from depositing on a developer carrier due to polarization force and intermolecule force. This reduces a change in the amount of charge to deposit on the developer attributable to, for example, inversely charged developer particles which is in turn attributable to the friction of a developer deposited on the developer carrier and a toner newly supplied to the developer carrier. The embodiment, therefore, can produce images of stable quality.

In the second embodiment, the developer is scarcely charged by the friction thereof with the surface of the developer carrier, but it is frictionally charged by another member, e.g., a developer regulating member. Hence, the factor that charges the developer does not change at all although the developer deposits on the surface of the developer carrier. It follows that the amount of charge to deposit on the developer carrier changes little, ensuring images of stable quality.

In the third embodiment, despite that the developer deposits on the surface of the developer carrier, it is not frictionally charged by surface potential stabilizing means. As a result, the surface potential of the developer carrier is prevented from becoming noticeably offset to one polarity, also ensuring images of stable quality.

Further, the fourth embodiment prevents charges from being injected into the surface of the developer carrier due to the contact of the image carrier with the developer and surface potential stabilizing means, an electric field derived from a potential difference in a developing region, etc. This protects images from degradation due to a residual image and a change in developing characteristic attributable to aging.

Various modifications will become possible for those skilled in the art after receiving the teachings of the present disclosure without departing from the scope thereof.

What is claimed is:

1. In a developing device for an image forming apparatus and comprising a developer carrier made up of a conductive base and an insulating layer formed on said conductive base for developing an electrostatic latent image formed on an image carrier with a one component type developer having high resistance, said insulating member of said developer carrier is made of a material produced by mixing a non-polar high molecule and a polar high molecule in a suitable ratio and scarcely storing a space charge.

2. In a developing device comprising a developer carrier consisting of a conductive base and an insulating layer formed on said conductive base for developing an electrostatic latent image formed on an image carrier with a one-component-type developer having a high resistance, said insulating layer of said developer carrier consists of a material produced by mixing at least two kinds of high molecule substances, each of which includes at least a non-polar high molecule substance and a polar high molecule substance such that a portion of said non-polar high molecule substance is more than 50%.

3. A developing device incorporated in an image forming apparatus for developing a latent image electrostatically formed on an image carrier with a one component type developer having high resistance, said device comprising:

a developer regulating member made of a conductive material for regulating a thickness of the developer;

a developer carrier made up of a conductive base and an insulating layer formed on said conductive base; and surface potential stabilizing means located between a developing region where said image carrier and said developer carrier face each other and developer supplying means, and held in contact with said developer carrier for dissipating a charge remaining on a surface of said developer carrier, said surface potential stabilizing means being made of a material substantially identical with the developer in charge series;

a predetermined potential being set up between said developer regulating member and said conductive base of said developer carrier.

4. The developing device according to claim 3, wherein the surface potential stabilizing means comprises a discharge brush.

5. A developing device incorporated in an image forming apparatus for developing a latent image electrostatically formed on an image carrier with a one component developer, said device comprising:

a developer regulating member made of a conductive material for regulating a thickness of the developer;

a developer carrier made up of a conductive base and an insulating layer formed on said conductive base and made of a first predetermined material, wherein said first predetermined material is substantially identical with the one component developer in charge series; and a surface potential stabilizing means located between a developing region where said image carrier and said developer carrier face each other and developer supplying means, and held in contact with said developer carrier for dissipating a charge remaining on a surface of said developer carrier, said surface potential stabilizing means being made of a second predetermined material substantially identical with the one component developer in charge series;

a predetermined potential being set up between said developer regulating member and said conductive base of said developer carrier.

6. The developing device according to claim 5, wherein the first predetermined material comprises polystylene resin and the one component developer comprises a negative polarity control agent.

7. The developing device according to claim 5, wherein the first predetermined material comprises nylon resin and the one component developer comprises a positive polarity control agent.

8. The developing device according to claim 5, wherein the first predetermined material comprises a non-polar high molecule.

9. The developing device according to claim 5, wherein the second predetermined material comprises carbon fiber.

10. The developing device according to claim 5, wherein the surface potential stabilizing means comprises a discharge brush.

11. A developing device incorporated in an image forming apparatus for developing a latent image electrostatically formed on an image carrier with a one component developer having a positive or negative charge series, said device comprising:

a developer regulating member made of a conductive material for regulating a thickness of the developer;

a developer carrier made up of a conductive base and an insulating layer formed on said conductive base and made of a first predetermined material, wherein said first predetermined material has a negative charge series when the one component developer has a negative charge series and wherein said first predetermined material has a positive charge series when the one component developer has a positive charge series; and a surface potential stabilizing means located between a developing region where said image carrier and said developer carrier face each other and developer supplying means, and held in contact with said developer carrier for dissipating a charge remaining on a surface of said developer carrier, wherein said surface potential stabilizing is made of a second predetermined material substantially identical with the one component developer in charge series;

a predetermined potential being set up between said developer regulating member and said conductive base of said developer carrier.

12. The developing device according to claim 11, wherein the first predetermined material comprises polystylene resin when the one component developer has a negative charge series and comprises nylon resin when the one component developer has a positive charge series.

13. The developing device according to claim 11, wherein the first predetermined material comprises a non-polar high molecule.

14. The developing device according to claim 11, wherein the second predetermined material comprises carbon fiber.

15. The developing device according to claim 11, wherein the surface potential stabilizing means comprises a discharge brush.

* * * * *